United States Patent [19]

Uetsuki

[11] Patent Number: 4,996,465

[45] Date of Patent: Feb. 26, 1991

[54] VARIABLE COLOR LIGHTING DEVICE

[75] Inventor: Tadao Uetsuki, Osaka, Japan

[73] Assignee: Matsushita Electric Works, Ltd., Japan

[21] Appl. No.: 370,252

[22] Filed: Jun. 22, 1989

[30] Foreign Application Priority Data

Jun. 27, 1988 [JP] Japan ..... 63-158465
Nov. 16, 1988 [JP] Japan ..... 63-290781

[51] Int. Cl.[5] ..... H01J 17/36

[52] U.S. Cl. ..... 315/358; 315/48; 313/493; 313/622; 313/487

[58] Field of Search ..... 315/358, 289, 48; 313/642, 622, 491, 484

[56] References Cited

U.S. PATENT DOCUMENTS 1,827,705 10/1931 Claude et al. ..... 315/358
2,135,283 11/1938 Found ..... 315/358
2,740,914 7/1952 Bowtell et al. ..... 313/491
3,875,453 4/1975 Thornton, Jr. ..... 313/642
4,740,729 4/1988 Chow ..... 313/622

FOREIGN PATENT DOCUMENTS 53-42386 11/1978 Japan .

*Primary Examiner*—Eugene R. LaRoche
*Assistant Examiner*—Son Dinh
*Attorney, Agent, or Firm*—Leydig, Voit & Mayer

[57] ABSTRACT

A variable color lighting device employs two gases having different ionization potentials and sealed in a lamp tube. A cathode and anode are disposed inside the lamp tube opposed to each other and connected to a power supply source for varying applied voltages thereto to vary light emitting ratio of the two gases for different color light generation, in accordance with the applied voltages. A variable color lighting can be realized at relatively low voltages with a simple and economical control circuit, and an increased light emission output can be attained to render the device utilizable as a main lighting source.

3 Claims, 3 Drawing Sheets

Fig. 6
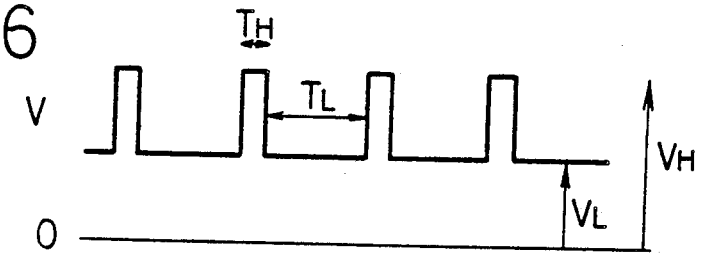
Fig. 7
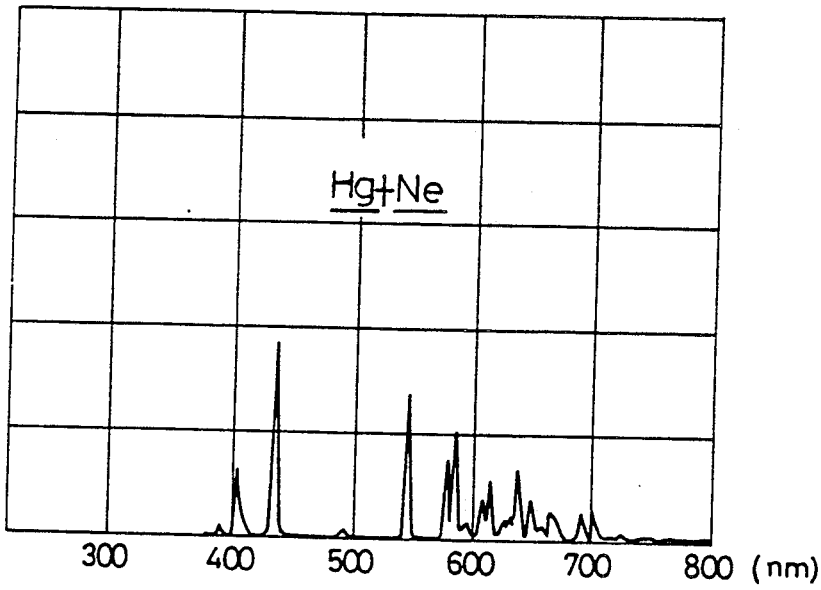
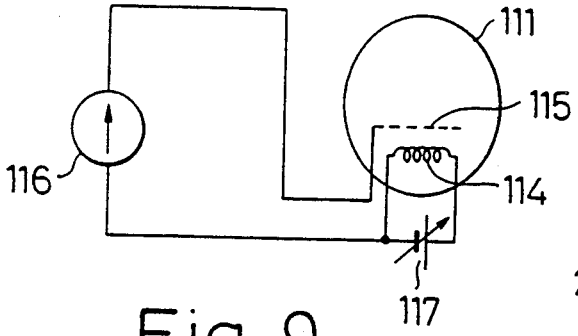
Fig. 9
Fig. 11
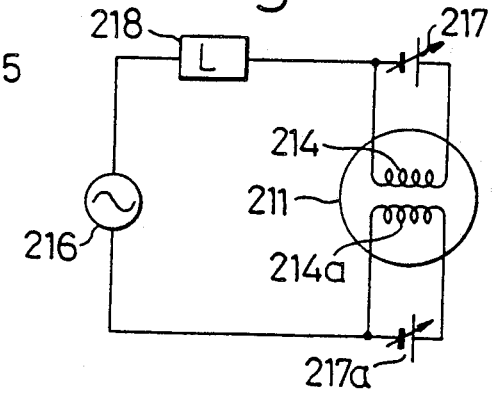

VARIABLE COLOR LIGHTING DEVICE

TECHNICAL BACKGROUND OF THE INVENTION

This invention relates to a variable color lighting device which varies the color of emitted light with a single lamp.

The variable color lighting device of the kind referred to can be utilized not only as a light source for displaying purpose but also effectively as a main illumination light source.

DISCLOSURE OF PRIOR ART

The variable color illumination or variable color light source has been studied and developed in various ways and part of them has been already utilized in practice. Such devices already put in practical use are mostly of a combination as a unit of colored incandescent light bulbs or fluorescent lamps emitted light of which will be adjusted to vary the color of emitted light. The variable color lighting has been achievable with such known arrangement, but there has been involved a problem in achieving a sufficiently satisfactory brightness. Further it has been troublesome to obtain a sufficiently large output with such unit of the three bulbs of lump tubes which itself has been bulky.

In a Japanese Patent Publication No. 53-42386 of Dr. R. Itatani, there has been disclosed a lamp in which mercury vapor and neon gas are sealed in a single straight tube and the lamp is lighted with the field strength of the positive column varied. In this case, a glow discharge employed for lighting this lamp generates a light emission in which the mercury vapor of a lower ionization potential is to be main within the lamp to allow a blue color light emission achieved, while the lamp having fluorescent substance allows a light emission of the particular fluorescent substance to be achieved. Further, when a pulse voltage showing a rapid rising is applied to the lamp, the field strength within the positive column increases to generate a light emission in which the neon of the higher ionization potential will be main so that, when the lamp is of a clear tube, a red color light emission can be attained, while the lamp having the fluorescent substance allows a light emission of the fluorescent substance to which the red color light emission is added. Further, the field strength within the positive column is varied by changing the voltage wave form applied to the lamp, or varying the cycle of the pulse voltage applied.

The foregoing variable color lamp has been epochmaking in allowing the emitted light varied in the color with the arrangement of the single lamp tube but, since the arrangement requires to vary the field strength in the interior of the positive column, there has remained a problem in that an extremely high pulse voltage of several hundred to several thousand volts has been required to have the control circuit or the like made expensive, and the noise has been also large.

SUMMARY OF THE INVENTION

A primary object of the present invention is, therefore, to provide a variable color lighting device which is capable of varying the emitted light color with a simpler, inexpensive and low noise control circuit, and of achieving an output of an enough level for utilizing the device as a main illumination means.

According to the present invention, this object can be realized by means of a variable color lighting device in which two gases mutually different in the ionization potential are sealed in a light permeable lamp tube together with a thermionic emission type cathode and an electron permeating type anode which are opposed to each other with a space of several mm to several cm, wherein a voltage applied to the cathode and anode is so varied as to have light emission ratio of the two gases varied for emitting variable color light.

Other objects and advantages of the present invention shall be made clear in following description of the invention detailed with reference to preferred embodiments shown in accompanying drawings.

BRIEF EXPLANATION OF THE DRAWINGS

FIG. 6 is an explanatory view for an applied voltage upon taking the working aspect as in FIG. 5 of the device of FIG. 1;

FIGS. 7 and 8 are spectrum diagrams for light emissions upon application of different voltages in the device of FIG. 1;

FIG. 9 is a schematic circuit diagram of the device in another embodiment of the present invention;

FIG. 11 is a schematic circuit diagram of the device in a further embodiment of the present invention.

While the present invention shall now be explained with reference to the embodiments shown in the accompanying drawings, it should be appreciated that the intention is not to limit the invention only to these embodiments shown but rather to include all modifications, alterations and equivalent arrangements possible within the scope of appended claims.

DISCLOSURE OF PREFERRED EMBODIMENTS

Figure 1:
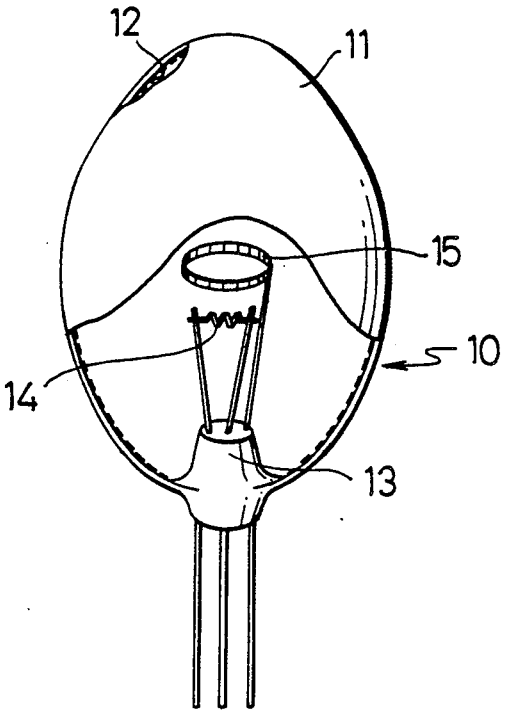
FIG. 1 is a schematic perspective view showing a lamp employed in an embodiment of the variable color lighting device according to the present invention, with a lamp tube of which shown as partly removed.
Figure 2:
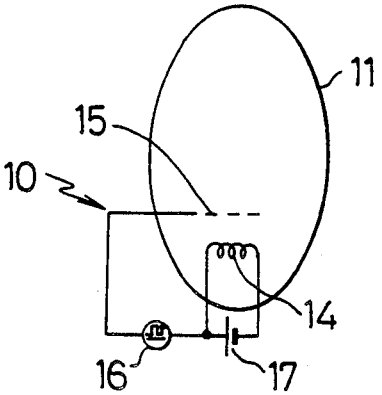
FIG. 2 is a schematic circuit diagram of the device shown in FIG. 1.

Referring here to FIGS. 1 and 2, there is shown a variable color lighting device 10 according to the present invention, and this device 10 includes a light permeable lamp tube 11. The interior wall surface of the tube 11 is coated with a fluorescent substance 12 preferably of a light bulb color or may not have any such coating, and two gases of different ionization potentials $V_1$ and $V_2$ are sealed in the tube 11. As the two gases, such a combination of mercury vapor and neon gas or the like may be utilized, under conditions of preferably $10^{-2}$ to $10^{-4}$ Torr for the mercury vapor and $10^{-1}$ to 10 Torr for the neon gas.

On a base portion 13 of the tube 11, there are provided a thermionic emission type cathode 14 and an electron permeating type anode 15 as opposed to each other with a space of several mm to several cm. For the cathode 14, for example, a tungsten filament with a barium Ba series emitter applied thereto may be employed. Between the cathode 14 and the anode 15, a power supply source 16 is connected while the cathode 14 is connected to a cathode heat source 17, so that a voltage will be properly applied across the cathode 14 and anode 15 and electrons thermionically emitted from the cathode 14 will move toward the anode 15 while being provided with an energy.

Figure 3:
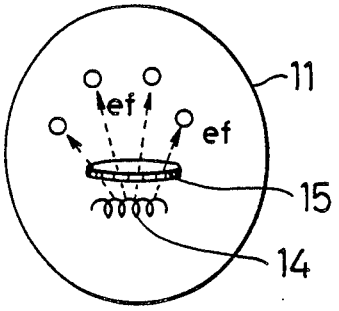
FIG. 3 is an explanatory view of a working aspect of the device of FIG. 1.
Figure 4:
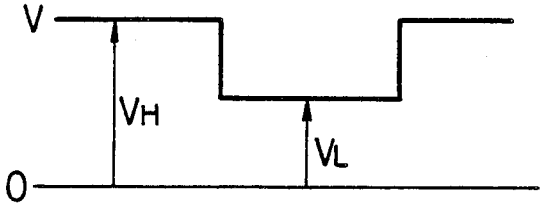
FIG. 4 is an explanatory view for an applied voltage upon taking the working aspect as in FIG. 3 of the device of FIG. 1.

Describing more in detail by referring additionally to FIG. 3, electrons ef emitted from the cathode 14 toward the anode 15 with such loci as shown by arrows will act to have one of the gases which is higher in the ionization potential and in the pressure mainly ionized when the energy provided by the voltage applied across the cathode 14 and anode 15 is high, and an excitation light emission is eventually caused. When the energy to the electrons ef is low, to the contrary, the electrons ef will act to have the other gas lower in the ionization potential and pressure mainly ionized for its excitation light emission. That is, when the potential of the anode 15 is varied, as shown in FIG. 4, to be at a relatively higher voltage $V_H$ and at a relatively lower voltage $V_L$, for example, at 25V and 20V, the energy of the emitted electrons can be varied. The ratio of one of the gases for causing the ionization and excitation light emission mainly is thereby varied so that, when such two different light-emission gases as mercury vapor and neon gas are employed, it is made possible to obtain a pink color light emission of the neon Ne gas when $V_H=25V$, as will be clear from the spectrum diagram of FIG. 7, and a blue color light emission mainly of the mercury Hg vapor when $V_L=20V$ (no light emission of Ne can be attained), as will be clear from the spectrum diagram of FIG. 8.

Figure 5:
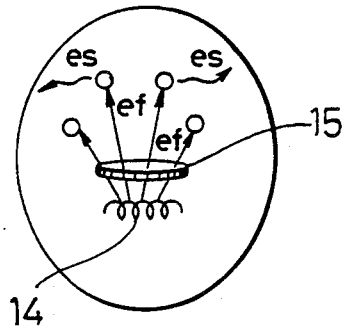
FIG. 5 is an explanatory view for another working aspect of the device of FIG. 1.

The present invention in another working aspect shall now be explained with reference also to FIG. 5. The electrons ef emitted from the cathode 14 as shown by such loci as shown by arrows in FIG. 5 cause lower energy electrons es to be generated when the gases sealed in the tube 11 are ionized. When the energy of the electrons ef is lower than $e \cdot V_2$ but higher than $e \cdot V_1$, the gas of the relatively lower ionization potential $V_1$ is mainly ionized (upon application of such voltage $V_L$ as in FIG. 6) for its excitation light emission. When the energy of the electrons ef is higher than $e \cdot V_2$, on the other hand, the other gas of the relatively higher ionization potential $V_2$ is ionized (upon application of such voltage $V_H$ as in FIG. 6) for its excitation light emission. In an event where an application time $T_H$ of the pulsating high voltage $V_H$ is short while an application time $T_L$ of the relatively lower voltage $V_L$ is longer, the gas of the ionization potential $V_2$ is caused to be reduced in the excitation generated within a life time of the electrons ef to reduce the light emission, whereby the light emission mainly of the gas of the ionization potential $V_1$ is caused to occur. In an event where the application time $T_H$ of the relatively higher voltage $V_H$ is short but the application time $T_L$ of the relatively lower voltage $V_L$ is also short, further electrons ef are caused to be emitted before the electrons already emitted disappear, to have the gas of the ionization potential $V_2$ ionized for its light emission. Accordingly, the two different light-emission spectrums can be optimumly attained by properly varying the higher and lower application voltages $V_H$ and $V_L$ as well as the longer and shorter application times $T_H$ and $T_L$.

When in the above the ionization potentials $V_1$ and $V_2$ of the two gases sealed-in and the relatively higher and lower application voltages $V_H$ and $V_L$ are of such relationship as $V_1<V_L<V_2$; $V_H>V_2$, the light emission ratio of the two sealed-in gases can be varied to generate the variable color light. Further, it should be readily appreciated by any one skilled in the art that a control for achieving the above relationship can be attained by means of a simple circuit arrangement, and an effectively variable color lighting can be realized by means of considerably lower voltages than in any known devices to be applied to the cathode 14 and anode 15, while sufficiently increasing the light emission output.

Figure 8:
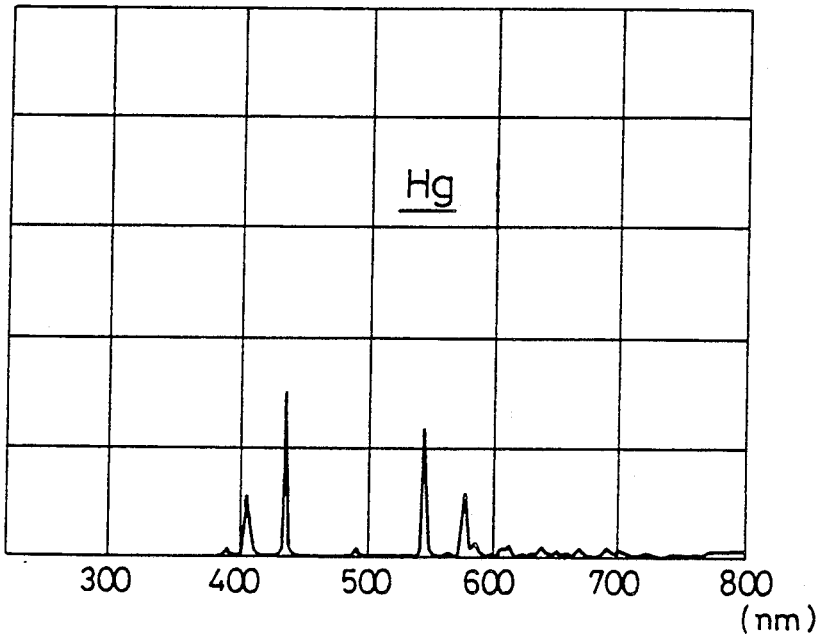

More concretely, an experimental lighting was carried out with the lamp tube 11 made 70 mm in the outer dimension and made to contain therein as the sealed-in gases the mercury Hg vapor of $10^{-2}$ to $10^{-4}$ Torr and the neon Ne gas of about 0.5 Torr for the excitation light emission with $V_H$ of 24 V and $V_L$ of 21 V. As a result, the pink color light emission of the neon Ne gas as shown in FIG. 7 could be mainly obtained with $T_H>0.05$ msec. or $T_L \leqq 1.25$ msec., and the blue color light emission mainly of the mercury Hg vapor as shown in FIG. 8 could be attained with $T_H<0.05$ msec. and $T_L>1.25$ msec.

Referring next to FIG. 9, there is shown another embodiment of the variable color lighting device according to the present invention, in which a constant current source 116 is connected to a cathode 114 and anode 115 provided within a lamp tube 111, and an adjustable cathode heating source 117 is connected to the cathode 114. When this lighting device of the present embodiment is lit such that a constant current is supplied from the source 116 to the cathode 114 and anode 115 and a current feeding from the cathode heating source 117 to the cathode 114 is made zero so as not to heat the cathode 114, the electrons ef are emitted from the cathode 114 toward the anode 115 with an energy corresponding to a relatively large cathode falling voltage. This energy reaches several tens of volts, whereby the neon Ne gas sealed in the tube 111 as an inert gas is mainly ionized to carry out the excitation light emission with the neon made as the main gas.

When on the other hand the current feeding from the constant current source 116 to the cathode 114 and anode 115 is carried out concurrently with the current feeding from the cathode heating source 117 to the cathode 114, a raised temperature at the cathode 114 renders the cathode fall voltage to be smaller so that the emission energy is also lowered. Accordingly, the neon Ne gas as the inert gas of a relatively higher pressure is rendered to be hardly ionizable, but the other mercury Hg vapor is mainly caused to be ionized to carry out the excitation light emission mainly with the gas. With the heating current for the cathode 114 controlled, the light emission ratio of the mercury Hg vapor and neon Ne gas is varied, so as to properly modify the emitted light color.

Figure 10:
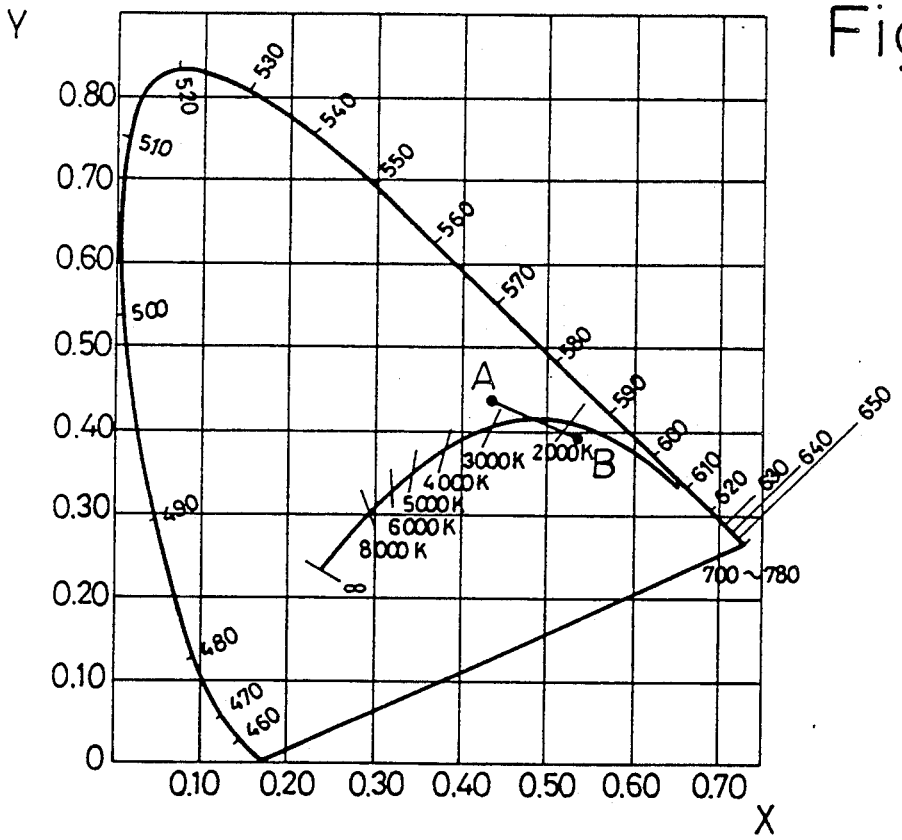
FIG. 10 is a chromaticity diagram for explaining an operation of the device of FIG. 9.

More concretely, the tube 111 was made to be of an outer dimension of 50 mm with interior wall coated by a fluorescent substance, for example, of a bulb color, the sealed-in gases were the mercury Hg vapor of $10^{-2}$ to $10^{-4}$ Torr and the neon Ne gas of about 5 Torr, a current of 600 mA was fed from the constant current source 116 to the cathode 114 and the feed voltage from the cathode heating source 117 was varied in a range of 0 to 7 V. As a result, in the chromaticity diagram of FIG. 10, the emitted light color could be varied in a range from point A ($x=0.534$; $y=0.398$) to point B ($x=0.439$; $y=0.435$).

In the embodiment of FIG. 9, other arrangements and operation are the same as in the foregoing embodiment.

Referring now to FIG. 11 showing a variable color lighting device of an alternating current lighting in another embodiment of the present invention, in which a pair of thermionic emission type electrodes 214 and 214*a* are disposed to oppose each other in a lamp tube 211, a voltage of an alternating current source 216 is applied through an impedance element 218 to these electrodes 214 and 214*a*, and adjustable heating sources 217 and 217*a* are inserted with respect to the both electrodes 214 and 214*a*. Therefore, in the present embodiment, too, substantially the same operation as in the embodiment of FIG. 9 can be realized by adjusting the heating power from the respective sources 217 and 217*a* to the respective electrodes 214 and 214*a*.

Other arrangements and operation of the embodiment of FIG. 11 are the same as those in the foregoing embodiments.

What is claimed is:

1. A variable color lighting device comprising:

a light permeable tube, mercury vapor and neon gases having different ionization potentials $V_1$ and $V_2$, respectively, sealed in said tube, a thermionic emission type cathode disposed in said tube, a heat source connected to said cathode for heating said cathode and causing electrons to be thermionically emitted from said cathode, an electron permeating type anode also disposed in said tube spaced from said cathode by several mm to several cm, a variable voltage power source means connected to said cathode and anode for applying voltages to said cathode and anode to impart varying accelerating energy to the electrons and to ionize the respective gases in said tube to emit light of different color, said gases having a light-emission ratio which varies in accordance with the voltages applied to said cathode and anode to generate variable color light, p1 said variable voltage power source means being adjusted to apply a relatively higher voltage $V_H$ and a relatively lower voltage $V_L$ to said cathode and anode, the applied voltages $V_H$ and $V_L$ being in such relationship to the ionization potentials $V_1$ and $V_2$ of said gases that $V_1 < V_L < V_2$ and $V_H > V_2$.

2. A device according to claim 1 which further comprises means for applying to said cathode and anode a constant relatively low voltage $V_L$, said voltage varying means including means for applying to said cathode and anode a relatively high pulsating voltage $V_H$, said applied voltages $V_H$ and $V_L$ being in such relationship to said ionization potentials $V_1$ and $V_2$ of said gases that $V_1 < V_L < V_2$ and $V_H > V_2$.

3. A device according to claim 1 which further comprises means for providing to said cathode and anode means always a constant current, said voltage varying means including means for varying heating power with respect to the cathode means.

* * * * *

UNITED STATES PATENT AND TRADEMARK OFFICE

CERTIFICATE OF CORRECTION

PATENT NO. : 4,996,465

DATED : February 26, 1991

INVENTOR(S) : Tadao Uetsuki

It is certified that error appears in the above-identified patent and that said Letters Patent is hereby corrected as shown below:

Column 6, line 12, delete "p1", and "said" should begin another paragraph.

Signed and Sealed this

Twenty-eighth Day of July, 1992

*Attest:*

DOUGLAS B. COMER

*Attesting Officer*

*Acting Commissioner of Patents and Trademarks*